US006530630B2

(12) United States Patent
Herbeck et al.

(10) Patent No.: US 6,530,630 B2
(45) Date of Patent: Mar. 11, 2003

(54) PANEL SEAL FOR AN AIR HANDLING UNIT

(75) Inventors: Christian C. Herbeck, Manchester, TN (US); Michael W. Austin, McMinnville, TN (US)

(73) Assignee: Carrier Corporation, Farmington, CT (US)

( * ) Notice: Subject to any disclaimer, the term of this patent is extended or adjusted under 35 U.S.C. 154(b) by 18 days.

(21) Appl. No.: 09/904,672

(22) Filed: Jul. 13, 2001

(65) Prior Publication Data

US 2003/0020382 A1 Jan. 30, 2003

(51) Int. Cl.[7] ..... A47G 29/00

(52) U.S. Cl. ..... 312/265.4; 277/637; 277/644; 277/921; 52/653.1

(58) Field of Search ..... 277/637, 644, 277/921, 648; 403/217–219, 170, 171; 55/653.1, 653.2, 655.1, 656.9; 312/265.1–265.4, 265.6, 223.1

(56) References Cited

U.S. PATENT DOCUMENTS

| | | | | | |
|---|---|---|---|---|---|
| 1,625,764 | A | * | 4/1927 | Bosley | 112/417 |
| 2,554,610 | A | * | 5/1951 | Benson | 277/641 |
| 2,607,966 | A | * | 8/1952 | Beck | 277/641 |
| 2,853,330 | A | * | 9/1958 | Harry | 277/649 |
| 2,935,157 | A | * | 5/1960 | First | 160/113 |
| 3,026,367 | A | * | 3/1962 | Hartwell | 174/35 GC |
| 3,029,480 | A | * | 4/1962 | Signorelli et al. | 156/252 |
| 3,240,862 | A | * | 3/1966 | Merkl et al. | 174/35 MS |
| 4,069,627 | A | * | 1/1978 | Pegg | 52/204.599 |
| 4,258,511 | A | * | 3/1981 | Strain | 52/270 |
| 4,715,609 | A | * | 12/1987 | Mino et al. | 277/608 |
| 5,066,161 | A | * | 11/1991 | Pinney | 403/172 |
| RE34,393 | E | * | 9/1993 | McIlwraith | 312/265.4 |
| 5,586,772 | A | * | 12/1996 | Deaver | 277/642 |
| 5,611,550 | A | * | 3/1997 | Belser | 277/642 |
| 5,651,803 | A | * | 7/1997 | Diachuk | 55/350.1 |
| 5,713,651 | A | * | 2/1998 | Essig et al. | 312/265.4 |
| 5,732,760 | A | * | 3/1998 | Pattison | 160/371 |
| 6,179,398 | B1 | * | 1/2001 | Martin | 312/223.1 |
| 6,322,111 | B1 | * | 11/2001 | Brady | 277/647 |

FOREIGN PATENT DOCUMENTS

DE 44 39 622 C1 * 11/1995

* cited by examiner

*Primary Examiner*—Anthony Knight
*Assistant Examiner*—Alison K. Pickard
(74) *Attorney, Agent, or Firm*—Wall Marjama & Bilinski LLP

(57) ABSTRACT

An air handling system containing sections each having a framework made up of tubular structural elements defining each perpendicularly aligned openings each of which shares a common structural element with its neighbors. The openings are closed by panels that are latched into the openings. Said assemblies are installed around the perimeter of each rectangular opening. Each assembly includes a rigid plate having two bulb seals extending along opposite edges of the plate that are coextruded with the plate. The plate is mounted at about a 45° angle along an inside corner edge of each commonly shared structural element so that a seal on one side of the plate services one opening while the other seal services the adjacent opening. The ends of the seals are mitered and the plate is inserted into a slot formed in molded corner retainers that support the structural elements in assembly. The mitered corners of the four seals surrounding an opening are placed in abutting contact to create a positive seal about each opening in the modular section.

9 Claims, 4 Drawing Sheets

PANEL SEAL FOR AN AIR HANDLING UNIT

FIELD OF THE INVENTION

This invention relates to an air handling system and, in particular, to a panel seal for use in an air handling system.

BACKGROUND OF THE INVENTION

Some air handling units in current use are equipped with an open structural framework and the openings in the framework are closed by panels that seal against the structural elements forming the opening. Adhesive backed gaskets are placed about the inside perimeter of the panel which, when brought into pressure contact with the structural elements, form a seal to prevent air from passing out of the unit around the panel. The gaskets are difficult to install involving a good deal of cutting and fitting which, in turn, generates a good deal of scrap material. In addition, it is oftentimes extremely difficult to achieve the uniform pressure needed to produce a seal and, as a result, leaks in the unit occur. Over time, the panels may be repeatably removed and replaced weakening or damaging the adhesive material again producing leaks in the unit and eventual replacement of the gaskets.

SUMMARY OF THE INVENTION

It is, therefore, an object of the present invention to improve air handling units.

It is a further object of the present invention to improve panel seals utilized in air handling units.

A still further object of the present invention is to provide a panel seal for an air handling unit that can be quickly installed in the unit.

Another object of the present invention is to provide a panel seal for an air handling unit that allows the panel to be repeatedly removed and reinstalled without jeopardizing the seal's integrity.

These and other objects of the present invention are obtained by a seal assembly suitable for use in an air handling unit having co-joined modular sections. Each section contains a framework having rectangular shaped openings. The openings are closed by means of panels that are locked into the openings by means of a series of latching mechanisms. The structural elements forming each rectangular shaped opening are each equipped with a guide rail for slidably receiving a seal assembly thereon. Each assembly, in turn, includes a pair of resilient bulb seals that are coextruded along opposed side edges of a stiff or rigid support plate that is arranged to engage a guide rail in sliding contact. The structural elements forming the opening are brought together by corner pieces. The corner pieces have slots formed therein for receiving the ends of the rigid support plates that surround the opening. The bulb seals in assembly pass outside the slots and are brought into contact with each other at the corners so that the seals encircle the opening perimeter so that when a panel is latched into the opening, the panel will compress the seals and provide a leak tight joint between the structural elements.

Typically, the openings in the framework are perpendicularly aligned with each other. The guide rails are mounted on structural elements that are commonly shared by two adjacent openings so that the bulb seal running along one edge of the support plate serves to seal one of the adjacent openings while the other bulb seal serves to seal the other adjacent opening.

BRIEF DESCRIPTION OF THE DRAWING

For a better understanding of these and other objects of the invention, reference will be made to the detailed description of the invention which is to be read in association with the accompanying drawings, wherein.

DETAILED DESCRIPTION OF THE INVENTION

Figure 1:
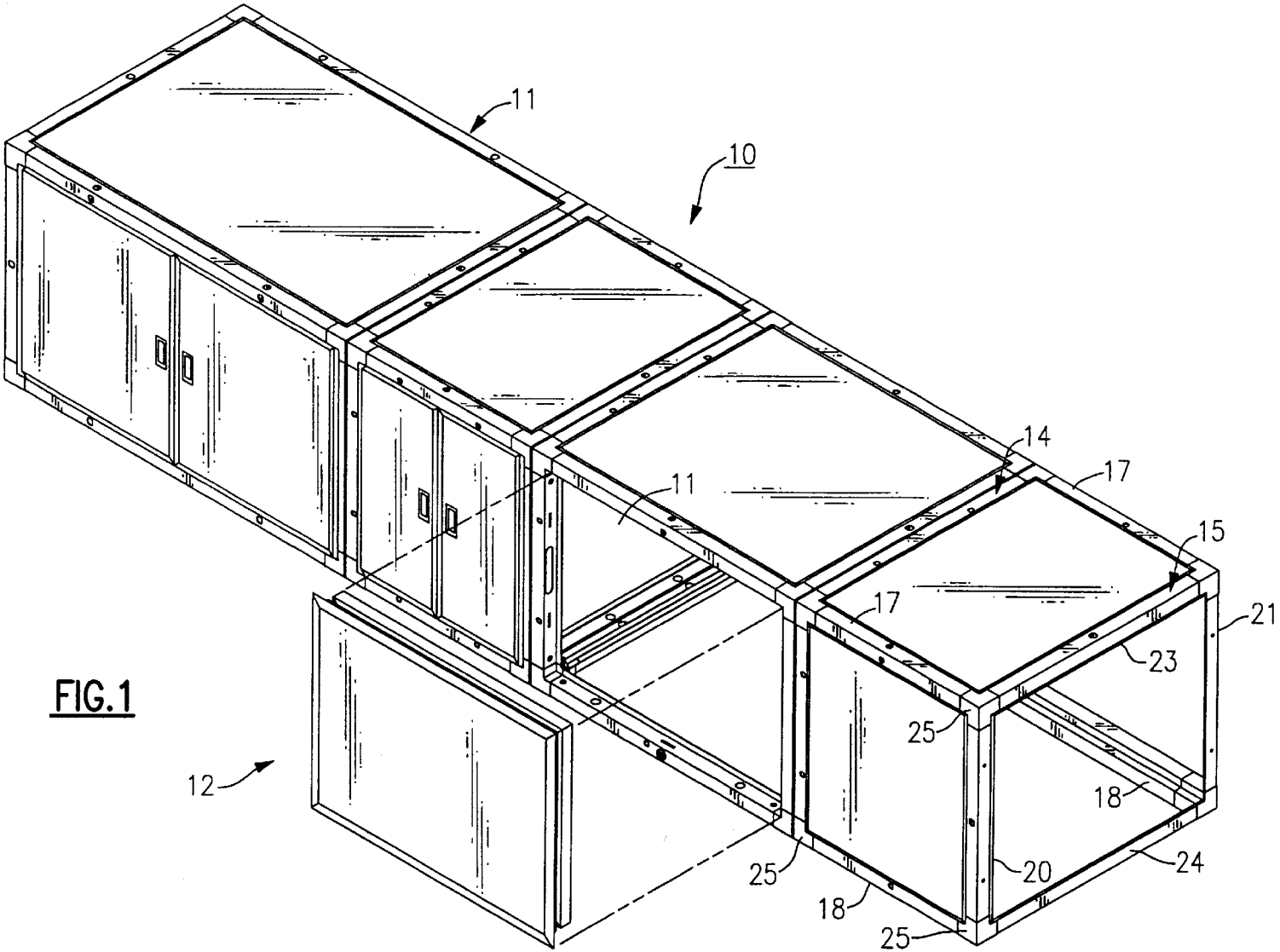
FIG. 1 is a perspective view showing a portion of an air handling unit embodying the teachings of the present invention.

Turning initially to FIG. 1 there is shown a portion of an air handling unit, generally referenced 10, that embodies the teachings of the present invention. The unit contains a series of rectangular shaped modular sections each of which includes a framework having a series of openings 11 that are closed by specially prepared panels 12 that act as a thermal barrier to impede the transfer of heat between the interior of the unit and the surrounding ambient. Although the panels provide an excellent thermal barrier to the flow of heat, air can move between the panels and the framework defining the openings thus defeating the integrity of the thermal barrier provided by the panels. As will be explained in further detail below, the present invention involves seals that are supported upon structural elements and are arranged to close against the entire periphery of each panel in assembly to provide a further thermal barrier, as well as preventing air from moving between the panels and the framework of the unit.

As further illustrated in FIGS. 2–7, the framework includes individual modular sections that are brought together in assembly to form an enclosed flow path for conducting conditioned air or the like along a desired path of travel. Each modular section of the unit includes a pair of opposed end frames 14 and 15 that are connected by horizontal square tubular beams which include two upper beams 17 and two lower beams 18. Each end frame further includes a pair of square tubular side rails 20 and 21, upper rail 23 and an opposed lower rail 24. The rails and beams of each section are interconnected by means of corner pieces 25. Each corner piece, in turn, contains a central hub 26 and three perpendicularly disposed arms 27–29 that emanate from the hub. Two of the arms 27 and 28 (FIG. 7) are contained in a common horizontal plane and a third arm 29 is contained in a vertical plane. Although not shown, the distal end of each arm is necked down and is slidably received inside of one of the hollow tubular structural elements that are connected to the end pieces. Each modular section thus contains four adjacent perpendicularly aligned openings that each share a common structural element with its neighbor.

The structural elements of the unit framework are fabricated of metal which, as in the case of most metals, has a relatively high thermal conductivity. The corner pieces on the other hand are fabricated of a high strength plastic material having a relatively low thermal conductivity, that is, a conductivity that is far less than that of the metal members. The conductivity of the corner pieces, like the panels, is such that the corner pieces act as a thermal barrier to the passage of heat.

Each of the tubular structural elements contains a pair of outwardly extended flat flanges 30 and 31 that coact as guide rails that run along an inside corner edge 32 of each commonly shared structural element. The height of the two flanges are about equal and each flange contains a proximal edge with the edges meeting at the inside corner of the commonly shared element. The two flanges in assembly form a right angle with respect to each other.

Figure 4:
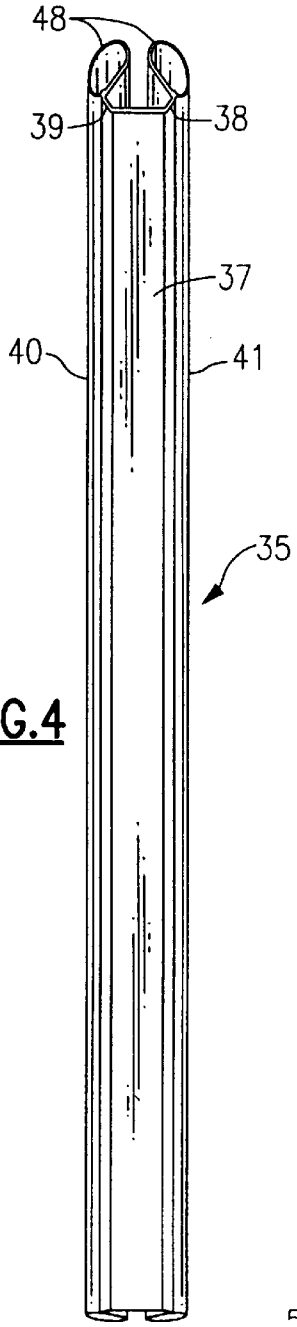
FIG. 4 is an enlarged top view of a seal assembly utilized in the present invention.
Figure 3:
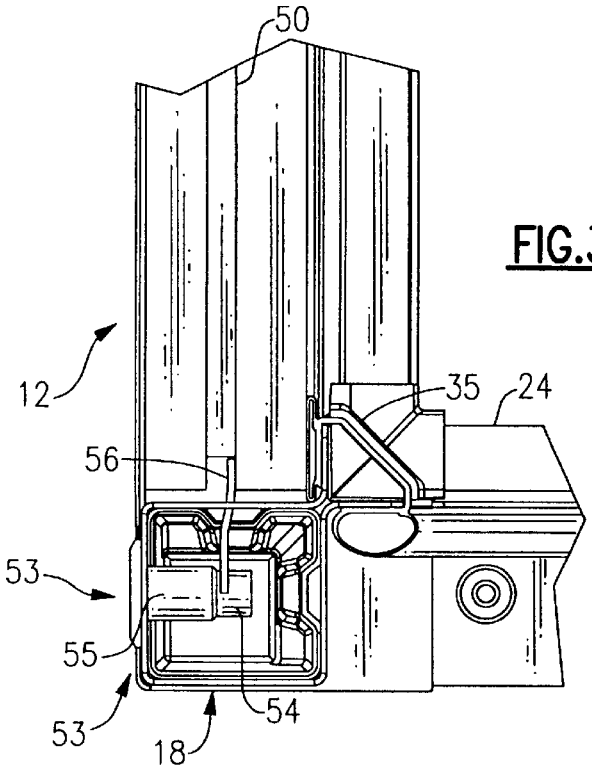
FIG. 3 is a view similar to that of FIG. 2 showing the panel mounted in the opening.
Figure 5:
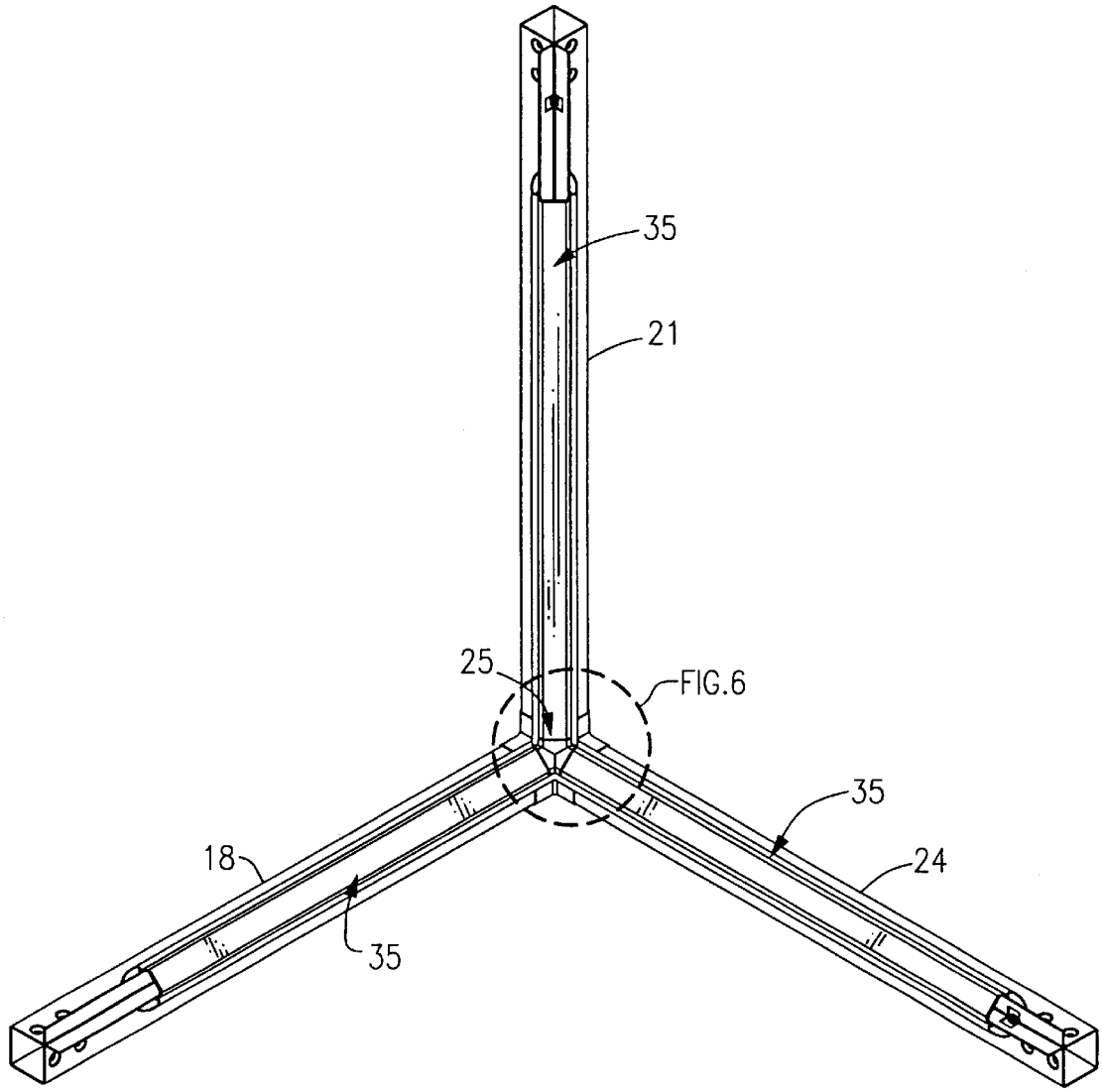
FIG. 5 is a perspective view showing a corner section of the air handling unit frame with the panels removed.
Figure 6:
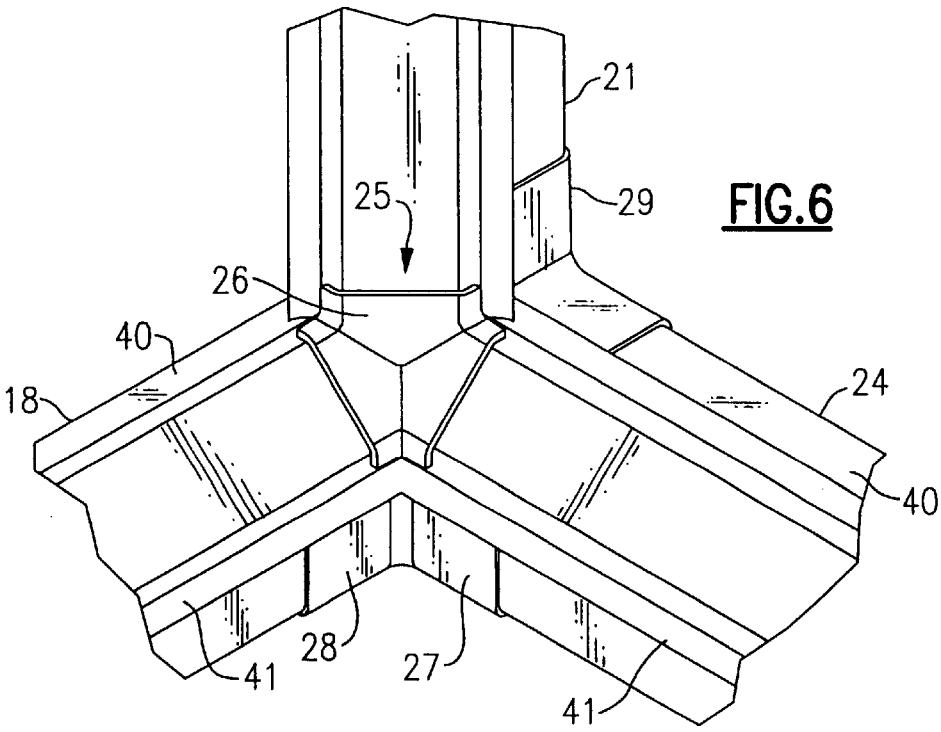
FIG. 6 is an enlarged partial view of a perspective corner piece used in the present invention showing a pair of seal assemblies retained within the corner piece.

As best see in FIG. 4, a seal assembly generally referenced 35 is slidably mounted upon the extended outer edges of the two perpendicular flanges. The assembly includes a rigid plate 37 having inwardly turned edges 38 and 39 that are arranged to hook over the outer edges of the flanges to slidably secure the assembly to the flanges. Bulb shaped seals 40 and 41 are carried upon the side edges of the plate and extend along the entire length of the plate. The seals and the plate are coextruded from materials having different durometers. The plate is formed of a relatively stiff material that will hold its shape while the bulb seals are formed of a resilient material. As illustrated in FIG. 3, the bulb seals can be readily compressed to conform to the shape of a compressing body such as one of the frame panels 12 to form a positive seal thereagainst.

Figure 7:
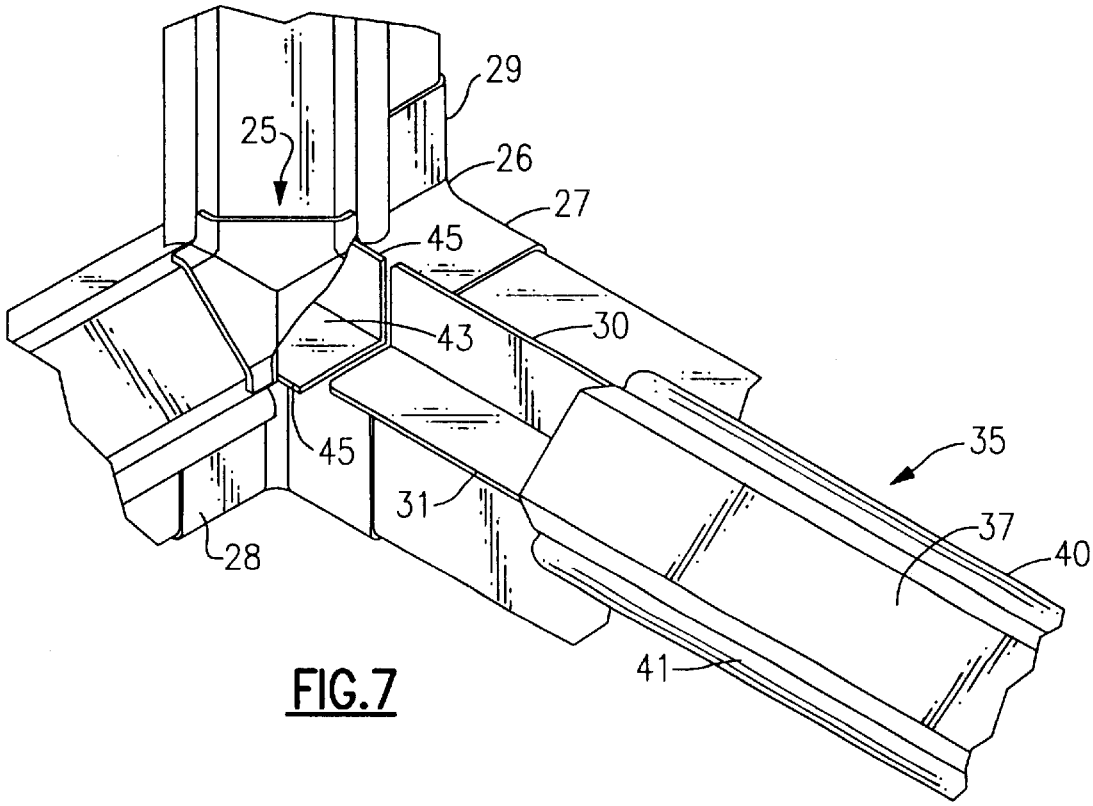
FIG. 7 is a view similar to that in FIG. 6 showing one of the seal assemblies drawn away from the corner piece.

As illustrated in FIG. 7, both ends of the seal supporting plates are received in openings 43 formed in the hub of each corner piece so that the body section of the plate is telescoped into the opening. Slots 45 are cut into the side walls of the openings to allow the two opposed seals to pass outside of each opening.

Figure 2:
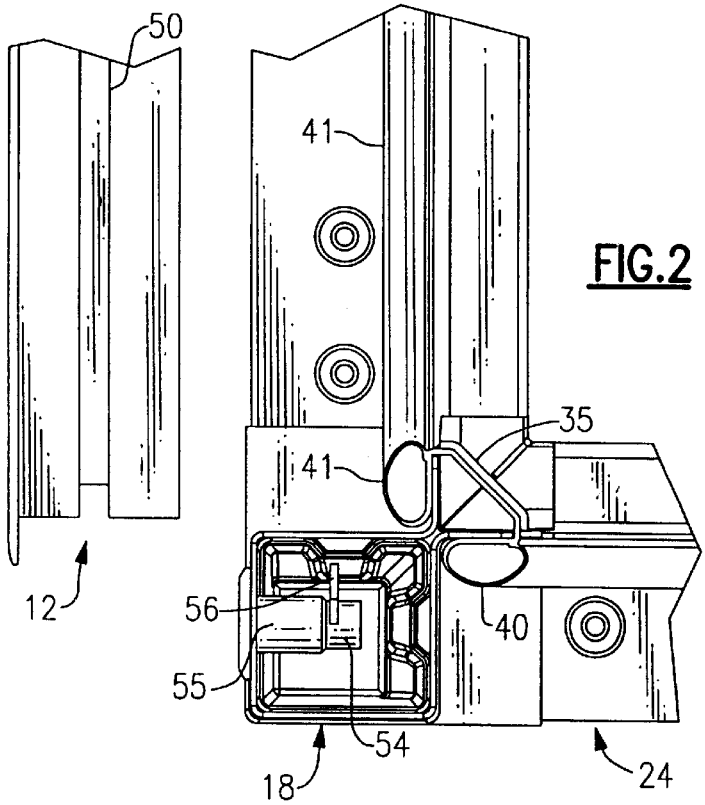
FIG. 2 is a partial enlarged sectional view taken along lines 2—2 in FIG. 1, showing a panel removed from one of the frame openings.

As can be seen from the drawings, three seal assemblies come together at each corner piece. The ends 48 of the seals contained in each assembly are mitered at a 45° angle so that the ends of the seals come together in each corner piece to form a leak tight joint therebetween. As should be now evident, four seals extend about the perimeter of each opening in the frame. When a panel is inserted into the opening as illustrated in FIG. 3, the four seals are compressed by the inner surface of the panel to completely seal the opening. Each panel has an inwardly directed recess 50 formed in its side walls that surround the entire panel. A series of latching mechanisms 53 are mounted inside of the structural elements surround each opening. Each latching mechanism includes a cylindrical rotor 54 that is rotatably mounted in a trunnion 55 secured in a supporting structural element. A latching arm 56 is secured to the free end of the rotor. The arm is capable of being turned by the rotor between a first recessed position as shown in FIG. 2 wherein the arm is located inside the structural element and a locking position as shown in FIG. 3 wherein the arm is in contact with a side wall of the recess surrounding the panel to hold the panel in tight sealing contact with the bulb seals surrounding the panel opening.

With all the panels locked in place, the air inside the unit sees only the seals, the corner pieces and the inside wall of the panels. All of these three components have a very low thermal conductivity, that is a thermal conductivity less than the metal beam and rail members. Accordingly, there is no conductive path extending between the interior of the air handling unit and the surrounding ambient that would permit heat to be readily transferred through the walls of the unit. This, in turn, prevents moisture from building up on the outside walls of the unit and provide for more effective conduction of conditioned air through the unit.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. In an air handling unit containing modular sections, each section having a framework with perpendicularly aligned rectangular shaped panel openings therein that are closed by close fitting panels that are latched into said panel openings, apparatus for sealing said panels in said panel openings that includes tubular structural elements mounted to form each panel opening so that each panel opening shares a common structural element with an adjacent perpendicularly aligned panel opening, said common structural elements each containing a rail extending along said element, a seal assembly mounted upon said rail that includes a rigid elongated plate having bulb seals mounted along opposing edges of said plate so that the bulb seal extending along one edge of the plate is capable of sealing against a first panel contained in one of the adjacent panel openings and the seal extending along the other edge is capable of sealing against a second panel contained in the adjacent perpendicularly aligned panel opening.

2. The air handling unit of claim 1 wherein said structural elements are square tubular members.

3. The air handling unit of claim 2 wherein said rails extends along one inside corner of each said common structural element.

4. The air handling unit of claim 3 that further includes corner pieces for connecting the tubular members forming a panel opening.

5. The air handling unit of claim 4 wherein each corner piece has a series of plate openings formed therein for receiving one end of the plates that come together at each corner of the panel opening.

6. The air handling unit of claim 5 wherein each plate opening contains slots therein so that the bulb seals on opposing side edges of the seal assemblies pass outside of said plate opening.

7. The air handling unit of claim 6 wherein the bulb seals are brought together in abutting contact at each corner piece so that the seals encircle each of the panel openings.

8. The air handling unit of claim 4 wherein each corner piece contains a central hub and three perpendicular arms emanating from the hub.

9. The air handling unit of claim 8 wherein each arm has a distal end that is necked down and inserted into one of the tubular structural elements that surround the panel opening.

* * * * *